US005652979A

United States Patent [19]

Pugh et al.

[11] Patent Number: 5,652,979

[45] Date of Patent: Aug. 5, 1997

[54] HOLDER FOR BED COVERINGS

[76] Inventors: Ormond P. Pugh; Sue Pugh, both of 14902 Shadow Wood Blvd., Hudson, Fla. 34667

[21] Appl. No.: 610,042

[22] Filed: Mar. 4, 1996

[51] Int. Cl.[6] ..... A47C 21/02

[52] U.S. Cl. ..... 5/504.1

[58] Field of Search ..... 5/504.1, 505.1, 5/506.1, 426; 403/259, 260

[56] References Cited

U.S. PATENT DOCUMENTS

| | | | |
|---|---|---|---|
| 1,175,526 | 3/1916 | Jones | 5/505.1 |
| 2,562,333 | 7/1951 | Ries | 5/504.1 |
| 2,976,546 | 3/1961 | Owens | 5/504.1 |
| 4,841,589 | 6/1989 | Moore | 5/505.1 |
| 5,001,795 | 3/1991 | Kasten | 5/504.1 |
| 5,305,480 | 4/1994 | Loren et al. | 5/504.1 |
| 5,426,800 | 6/1995 | St. John et al. | 5/504.1 |

FOREIGN PATENT DOCUMENTS

| | | | |
|---|---|---|---|
| 636452 | 5/1950 | United Kingdom | 5/426 |

*Primary Examiner*—Alexander Grosz

*Attorney, Agent, or Firm*—American Innovations, Inc.; Dorothy S. Morse

[57] ABSTRACT

A holder for bed coverings for use with an unencumbered edge of a bed, preferably the foot of a footboardless bed. The holder has several hollow tubes and an identical number of poles. Each hollow tube is positioned between the mattress and the box spring of the bed so that one of its ends is adjacent to the unencumbered edge of the bed. One end of each pole, being slightly smaller in diameter than each of the hollow tubes, is slidably inserted into one of the hollow tubes. The other end of each pole is attached to a vertical end piece so that the mattress, the vertical end piece, and the poles define a storage space for bed coverings and other objects. Applications may include, but are not limited to, use for supporting bedspreads, comforters, blankets, bathrobes, other clothing, extra pillows, and sheets.

2 Claims, 4 Drawing Sheets

HOLDER FOR BED COVERINGS

BACKGROUND

1. Field of Invention

This invention relates to bedspread holders for use with footboardless beds, specifically to a holder for bed coverings having several hollow tubes which are placed between a mattress and box spring, an identical number of poles each of which is slidably inserted into one of the hollow tubes, each pole also being attached to an elongated vertical end piece so that the mattress, the vertical end piece and the poles define a storage space for bed coverings adjacent to an unencumbered edge of a bed, preferably at the foot of a bed. Applications may include, but are not limited to, use for supporting bedspreads, comforters, blankets, bathrobes, other clothing, extra pillows, and sheets.

2. Description of Prior Art

Bedspreads are known to be used as a decorating element in bedrooms and many bedspreads are made from expensive fabrics which tend to wrinkle and become easily soiled when not properly cared for. It is known to have bedspread holders for use with footboardless beds which help to keep bed coverings neatly stored and clean when not in use on a bed. The holders also keep extra bed coverings close-at-hand for use when a person becomes chilled while laying in bed, may be used for temporary placement of bathrobes, other clothing, and extra pillows, and may be used to keep bed coverings made out of slippery material from falling off of the end of a bed at night and onto a floor where pets may lay on them or where someone may trip over them. There appear to be several types of bedspread holders, those that have a rod or tube over which bed spreads may be draped, those which define a space between the holder and a mattress for placement of bed coverings, those which create a platform on which bed coverings may be placed, and those which lift bed coverings into a canopy position overhanging a bed.

The invention in U.S. Pat. No. 3,885,256 to Du Boff (1975) discloses a bedspread holder and clothing valet over which bed coverings may be draped. The Du Boff holder has two U-shaped frame members pivotally connected to each other at their ends and a locking mechanism to secure the two U-shaped frame members in a fixed position relative to each other. During use, one of the U-shaped frame members is inserted between a mattress and box spring and the other U-shaped frame member moved to an upwardly depending position. A disadvantage of the Du Boff bedspread holder is that bed coverings are hung over the upwardly depending frame member and time must be taken to fold bed coverings prior to placing them over the frame member or the bed coverings are likely to drape on the floor where pets may lay on them or where they may pose a safety hazard and cause someone to trip over them.

The invention in U.S. Pat. No. 3,435,469 to Fricke (1969) discloses a collapsible bedspread holder which provides a platform onto which bed coverings may be placed. One part of the Fricke holder is placed between a mattress and a box spring, a second part is horizontally positioned at the foot of the bed, and a third part functions as a leg support for the second part. A disadvantage of the Fricke holder is that since it has a flat upper surface, and not a defined space for containing bed coverings, bed coverings which are likely to fall off of the end of a bed are also likely to fall off of the upper surface of the Fricke holder and land on the floor where pets may lay on them and where someone may trip over them. The invention in U.S. Pat. No. 3,518,706 to Crippen (1970) discloses a bedspread support which has a drive mechanism to lift bed coverings on a support frame into a canopy position overhanging a mattress. Although the Crippen support may prevent a bedspread from becoming wrinkled, it has the disadvantage of being complex in design and more expensive to use.

The prior art known to be most closely related to the present invention is the bedspread storing apparatus disclosed in U.S. Pat. No. 5,426,800 to St. John (1995) which creates a defined space between the apparatus and the mattress for containing bed coverings. The St. John apparatus comprises a pair of L-shaped members having elongated horizontal portions which are placed between a mattress and box spring during use. A vertically extending short portion on each L-shaped member is attached to a vertically disposed cross slat. The St. John apparatus also has at least one horizontal cross slat positioned adjacent to each vertical section across the horizontal portions of the L-shaped members. One disadvantage of the St. John apparatus is that to extend it away from the foot of a bed, the elongated horizontal portions of the L-shaped members must be moved along the inside surfaces of the mattress and box spring. With repeated movement the inside surfaces of the mattress and box spring covers are likely to become torn or chafed. It is not know to have a holder for bed coverings comprising several hollow tubes positioned between a mattress and its box spring with a pole slidably inserted into each of the hollow tubes, one end of each pole also being attached to an elongated vertical end piece so that the mattress, the vertical end piece and the poles define a storage space for bed coverings and expansion of that storage space involves a sliding movement of each pole within a hollow tube, and not direct sliding contact of each pole with the mattress and box spring covers.

SUMMARY OF INVENTION—OBJECTS AND ADVANTAGES

It is the primary object of this invention to provide a holder for bed coverings which will attach to an unencumbered edge of a bed between its mattress and box springs, preferably at the foot of a footboardless bed. It is also an object of this invention to provide a holder for bed coverings which is lightweight and easy to use. A further object of this invention is to provide a holder for bed coverings which will contain surplus bed coverings at night so they won't fall on the floor where they might become wrinkled, soiled by a pet, or where they might pose a safety hazard to someone getting up in the middle of the night. It is also an object of this invention to provide a holder for bed coverings with a means of expanding its containment space without chafing or tearing mattress and box spring covers. A further object of this invention is to provide a holder which may be disassembled for compact storage. It is also an object of this invention to provide a holder for bed coverings which may easily be collapsed into a compact configuration against a mattress when not in use. It is also an object of this invention to provide a holder for bed coverings with cutouts in its vertical end piece so that a portion of the vertical end piece may be used as a handle.

As described herein, properly manufactured and installed between the mattress and box spring of a bed, the present invention would provide an attractive holder for bed coverings which may be used with an unencumbered edge of a bed, preferably the foot of a bed. When in position for use, the holder and the mattress define a space for containment of a variety of bed coverings and other objects such as extra pillows, bathrobes, towels, and other clothing. The holder has hollow tubes which are positioned between a mattress and a box spring. One end of each hollow tube is positioned adjacent to the unencumbered edge of a bed requiring bed covering storage space. Poles which are attached to an elongated vertical end piece are slidably positioned within the hollow tubes. When not needed for use in supporting bed coverings and other objects, the vertical end piece may be easily moved into an out-of-the-way position against the mattress. When needed for use, cutouts in the vertical end piece may be used as handles to slide the vertical end piece away from the mattress to define a space for storage of bed coverings. Since the poles connected to the vertical end piece slide within the hollow tubes, the mattress and box spring covers do not become chafed or torn due to repeated movement of the vertical end piece. Also, the poles are attached to the vertical end piece by threaded, or other fast holding but easily separable, means so that the holder may be disassembled for compact storage.

The description herein provides preferred embodiments of the present invention but should not be construed as limiting the scope of the bed covering holder invention. Variations in the number of hollow tubes, the length of each hollow tube and pole, the type of attachment securing each pole to the elongated vertical end piece, the shape of the elongated end piece, the materials from which the hollow tubes, poles and elongated vertical end piece are made, other than those shown and described herein, can be incorporated into the present invention. Thus the scope of the present invention should be determined by the appended claims and their legal equivalents, rather than the examples given.

DETAILED DESCRIPTION OF PREFERRED EMBODIMENTS

Figure 1:
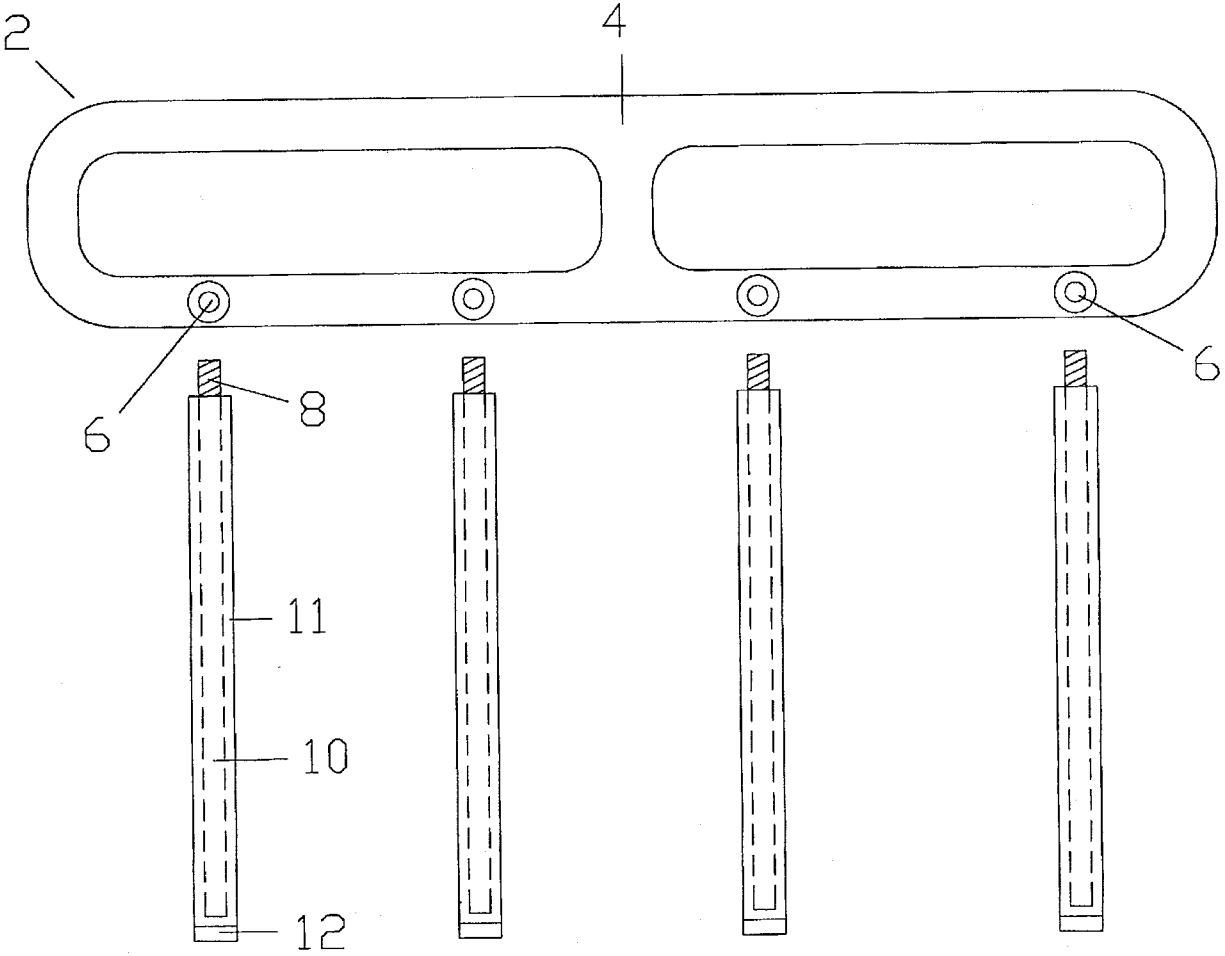
FIG. 1 is an unassembled view of the invention.

FIG. 1 shows a preferred embodiment of a bed covering holder 2 having an end piece 4 with four internally threaded holes 6 along one of its edges. FIG. 1 also shows four hollow tubes 11, each of which is surrounding a pole 10 which has an exposed externally threaded end 8 for engagement with one internally threaded hole 6. When end piece 4 is attached to poles 10 and positioned for use, it is contemplated for end piece 4 to be in an approximately vertical position. FIG. 1 also shows an end cap 12 is attached to one end of each hollow tube 11. Although FIG. 1 shows four hollow tubes 11, four internally threaded holes 6, four end caps 12, and four poles 10, the number of hollow tubes 11, internally threaded holes 6, end caps 12, and poles 10 is not critical to the present invention. It is contemplated only that the number of hollow tubes 11, internally threaded holes 6, end caps 12, and poles 10 be identical. Further, the length of each hollow tube 11 and each pole 10 is not critical to bed covering holder 2, as long as the length of each hollow tube 11 and each pole 10 is of sufficient length to support the weight of a bedspread 16, shown in FIGS. 5 and 7, when placed in the space defined between vertical end piece 4 and mattress 14. In the preferred embodiment it is contemplated for hollow tubes 11 to be long enough to be inserted approximately to the center portion of mattress 14. Also, the shape of end piece 4 is not critical to the present invention. It is contemplated for end piece 4 to have square corners, rounded corners, designs placed thereon, and cutout portions therethrough for use as handles (not shown). Also, although FIGS. 1 and 2 show threaded attachment of poles 10 to end piece 4, it is contemplated to have other means of secure attachment between poles 10 and end piece 4, such as spring biased locking means.

Figure 2:
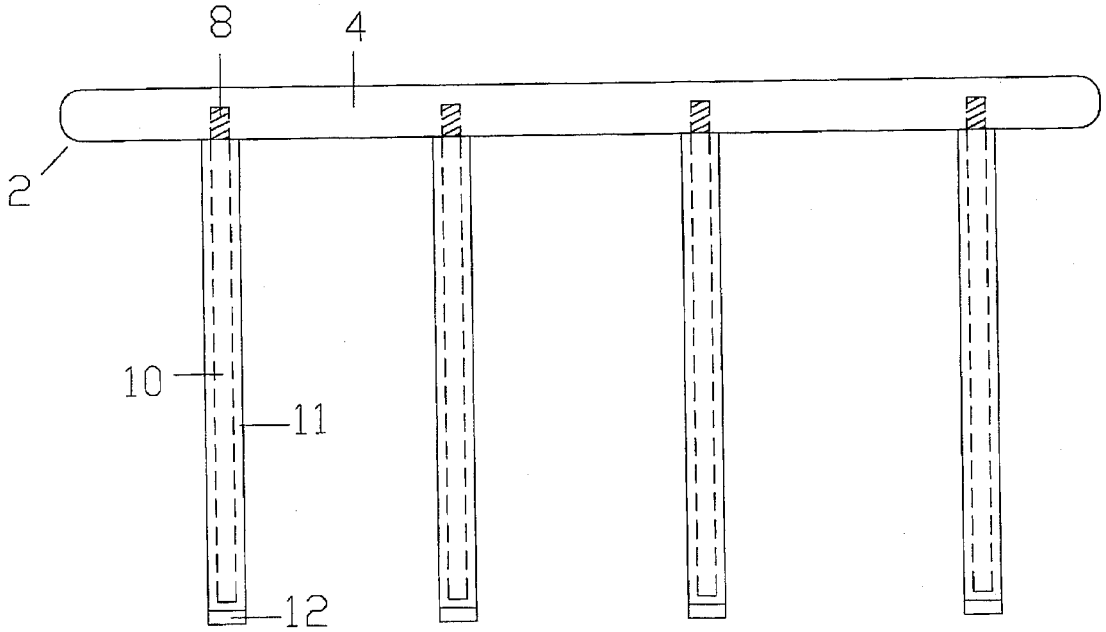
FIG. 2 is a top view of the invention.
Figure 3:
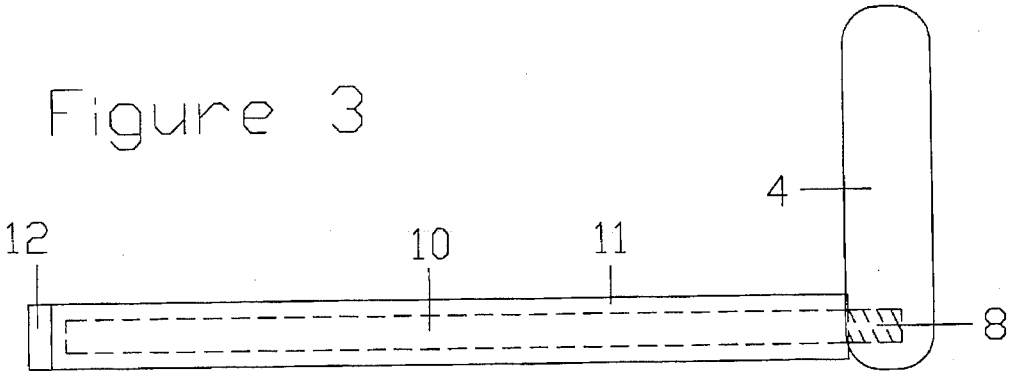
FIG. 3 is a side view of the invention.

FIGS. 2 and 3 show bed covering holder 2 having externally threaded ends 8 of poles 10 attached to end piece 4. Poles 10 are placed within hollow tubes 11 and end caps 12 are placed over the end of each hollow tube 11 which is remote from vertical end piece 4. In the preferred embodiment it is contemplated for end piece 4, poles 10, hollow tubes 11 and end caps 12 to be made of plastic. In the preferred embodiment it is also contemplated for hollow tubes 11 to be approximately one inch in diameter and for poles 10 to be approximately one-half inch in diameter. It is also contemplated for end piece 4 to have a variety of widths which conform to the widths of differing sizes of mattresses 14. Further, although in the preferred embodiment it is contemplated for bed covering holder 2 to be placed at the foot of mattress 14, bed covering holder may be placed along any unencumbered edge of mattress 14

Figure 5:
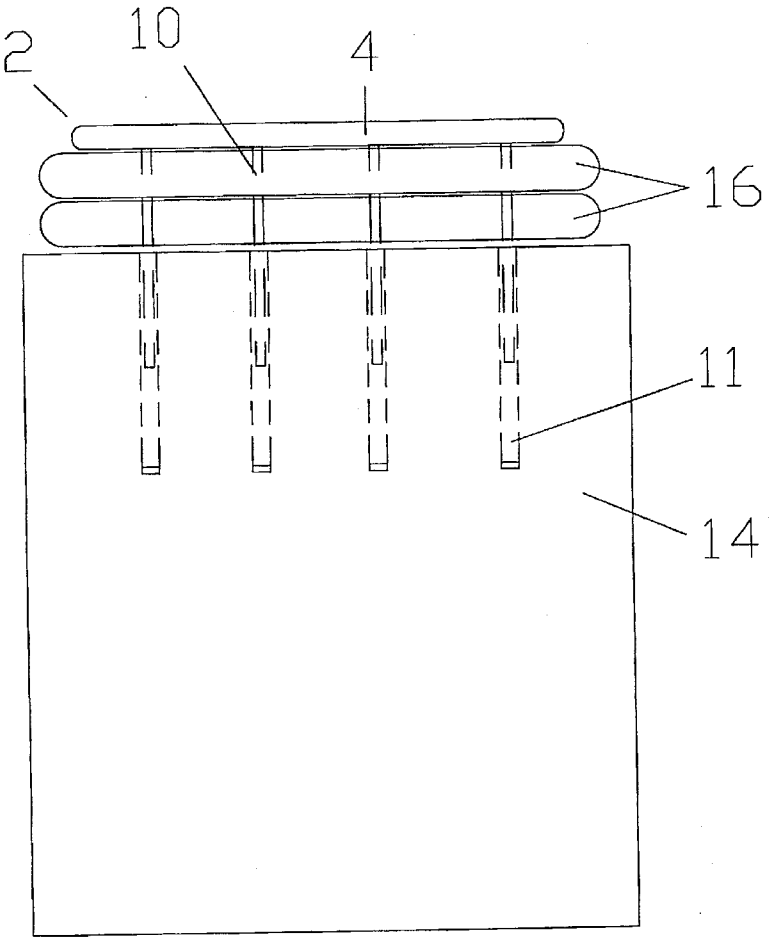
FIG. 5 is a top view of the invention in an extended position supporting bed coverings and inserted between the mattress and box spring of a bed.
Figure 4:
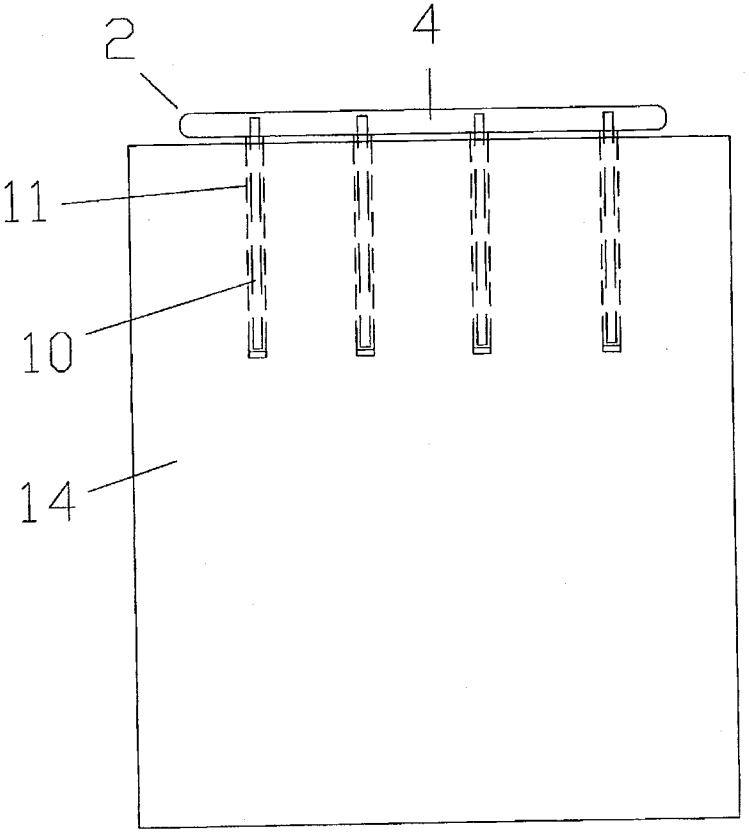
FIG. 4 is a top view of the invention in a retracted position against a mattress and inserted between the mattress and box spring of a bed.

FIGS. 4 and 5 show bed covering holder invention 2 having hollow tubes 11 positioned under a mattress 14. In FIG. 4 end piece 4 is moved adjacent to mattress 14 into an out-of-the-way position. In FIGS. 5 end piece 4 is positioned at a spaced distance away from mattress 14 so that a blanket 16 may be supported between end piece 4 and mattress 14.

Figure 6:
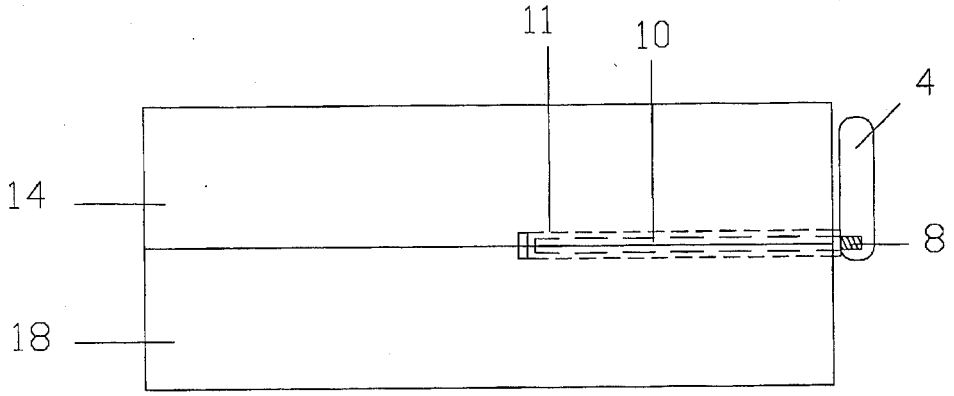
FIG. 6 is a side view of the invention in a retracted position against a mattress and inserted between the mattress and box spring of a bed.
Figure 7:
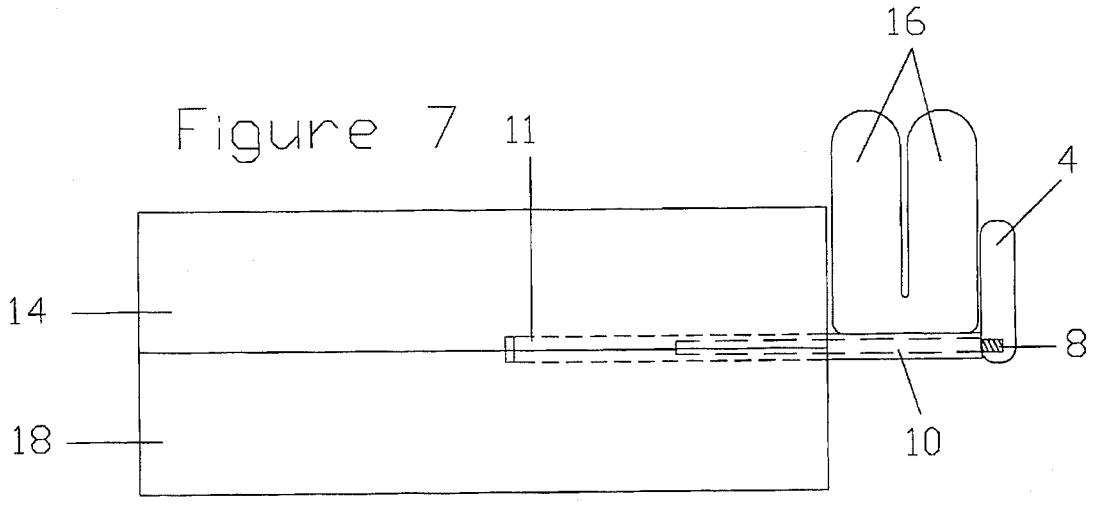
FIG. 7 is a side view of the invention in an extended position supporting bed coverings and inserted between the mattress and box spring of a bed.

FIGS. 6 and 7 show hollow tube 11 positioned between mattress 14 and a box spring 18, with pole 10 positioned within hollow tube 11. In FIG. 6 end piece 4 is shown attached to externally threaded end 8 of pole 10 and positioned adjacent to mattress 14. In FIG. 7 end piece 4 is shown attached to externally threaded end 8 of pole 10 and positioned at a spaced distance from mattress 14. FIG. 7 also shows bedspread 16 supported on pole 10 between mattress 14 and end piece 4.

To use bed covering holder 2, hollow tubes 11 are placed at spaced distances from each other between mattress 14 and box spring 18. One end of each hollow tube 11 is positioned at the unencumbered edge of mattress 14 where it is desired to place end piece 4. It is contemplated for each hollow tube 11 to have an end cap 12 placed on the end of hollow tube 11 remote from the unencumbered edge of mattress 14. Externally threaded end 8 of each pole 10 is screwed into one internally threaded hole 6 in end piece 4 so that end piece 4 is positioned approximately at right angles to poles 10. End piece 4 is then used to slide poles 10 in unison into hollow tubes 11. Bed covering holder 2 may be easily moved into an out-of-the-way position against mattress 14 by sliding poles 10 fully into hollow tubes 11, or moved to a spaced distance from mattress 14 so that bedspread 16, or other objects (not shown) may be stored within the space defined between end piece 4 and mattress 14.

What is claimed is:

1. A holder for bed coverings and other objects for use with a bed having a mattress, a box spring, and an unencumbered edge, said holder comprising a plurality of hollow tubes, each of said hollow tubes having opposite ends, a plurality of poles, and a vertical end piece having a plurality of cutout portions therethrough, each of said cutout portions being large enough for use as a handle, said vertical end piece also having a lower horizontal edge and a plurality of internally threaded holes, each of said internally threaded holes being adjacent to said lower horizontal edge, each of said poles having an externally threaded end, a non-threaded end, and being slightly smaller in diameter than said hollow tubes, each of said hollow tubes being positioned between said mattress and said box spring so that one of said opposite ends is positioned adjacent to said unencumbered edge, said non-threaded end of each of said poles being slidably inserted into one of said hollow tubes, each of said externally threaded ends being attached to said vertical end piece by threaded engagement with one of said internally threaded holes so that said mattress, said vertical end piece, and said poles define a storage space for said bed coverings and said other objects.

2. The holder of claim 1 further comprising a plurality of end caps, one of said end caps being attached to the other of said opposite ends of each of said hollow tubes.

* * * * *